United States Patent [19]

Slade, Jr. et al.

[11] Patent Number: 4,527,797

[45] Date of Patent: Jul. 9, 1985

[54] SYSTEM FOR WEIGHT LIFTING EXERCISING

[76] Inventors: James R. Slade, Jr., 45 Cedar Hill Rd., Randallstown, Md. 21133; Richard F. Sterba, 9536 Bauer Ave., Baltimore, Md. 21236

[21] Appl. No.: 479,311

[22] Filed: Mar. 28, 1983

[51] Int. Cl.[3] ..... A63B 21/00

[52] U.S. Cl. ..... 272/123; 272/DIG. 4; 272/118

[58] Field of Search ..... 272/118, 123, 122, 93, 272/117, 134

[56] References Cited

U.S. PATENT DOCUMENTS

| | | | |
|---|---|---|---|
| 3,346,256 | 10/1967 | White | 272/81 |
| 3,524,644 | 8/1970 | Kane | 272/134 |
| 3,948,513 | 4/1976 | Plotenhauer | 272/81 |
| 4,153,244 | 5/1979 | Tauber | 272/117 |
| 4,252,314 | 2/1981 | Ceppo | 272/117 |
| 4,306,715 | 12/1981 | Sutherland | 272/62 |
| 4,319,747 | 3/1982 | Rogers | 272/73 |

OTHER PUBLICATIONS

"Marcy Leg Press Machine"; Mary Physical Fitness Equipment Catalogue No. 71, p. 61.

*Primary Examiner*—Richard J. Apley
*Assistant Examiner*—William R. Browne
*Attorney, Agent, or Firm*—John F. McClellan, Sr.

[57] ABSTRACT

A system for weight lifting exercises provides the user with a guided leg press/multi-press that has a safety mechanism which is adjustably limitable to prevent a barbell, an assembly of weight plates on a weight lifting bar, from falling below a chosen height. A series of holes in uprights provide a range of adjustment for barbell support rods during guided bench-press and standing-press use on a slide assembly permit a plurality of barbells to be received at one time, thereby increasing the weight-load capacity of the slider system. A part of the system serves as a chin-up bar. Numerous exercises using the system may be performed. A supported barbell includes a pivotal foot-plate with angle limiting provision. A slider assembly may include a two-piece apertured flange for locking a barbell in place during an exercise.

17 Claims, 15 Drawing Figures

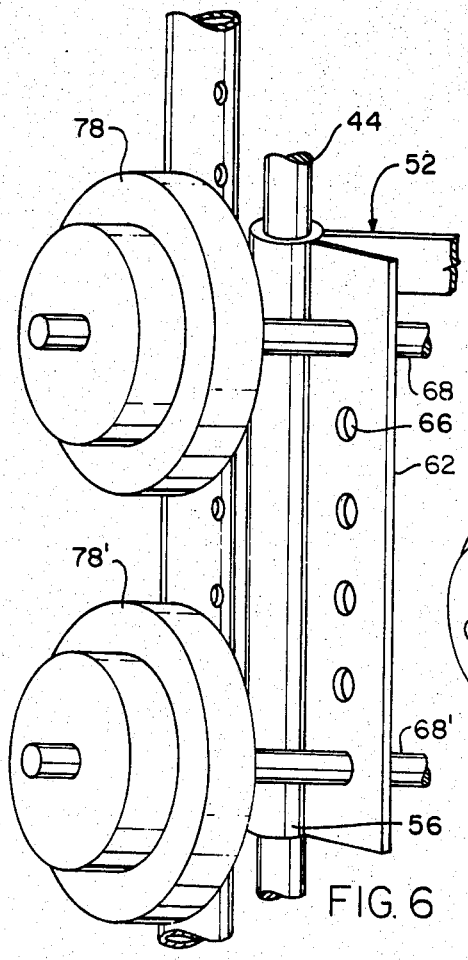
FIG. 6
FIG. 5
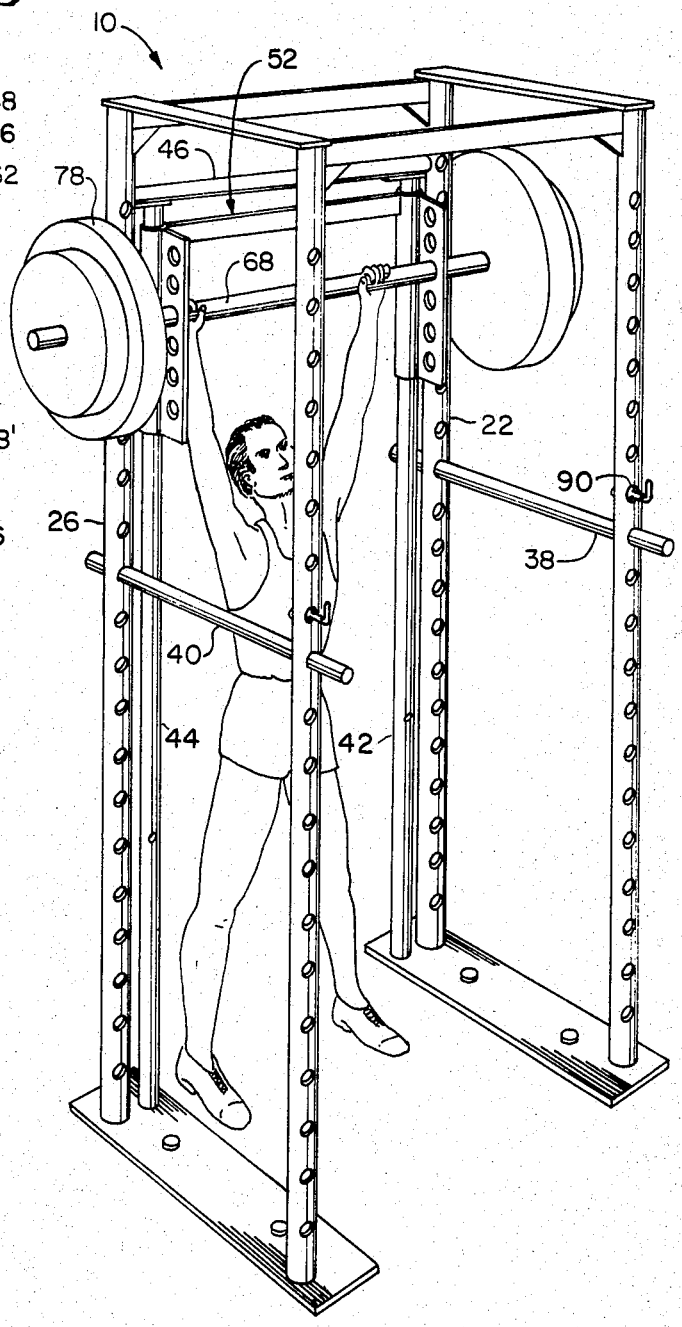

SYSTEM FOR WEIGHT LIFTING EXERCISING

FIELD OF THE INVENTION

This invention relates generally to athletic equipment and specifically to weight lifting type exercisers.

BACKGROUND OF THE INVENTION

In the prior art various weight lifting equipment have been disclosed, including that in the following U.S. patents:

No. 3,346,256 to J. R. White, 10 -10-67, disclosed a guided lift bar with adjustable weights;

No. 3,948,513 to J. M. Plotenhauer, 4-6-76, disclosed apparatus with four uprights having matching adjustment holes, and horizontal members for mounting to the uprights by pins through the holes;

No. 4,252,314 to L. Ceppo, 2-4-81, disclosed a guided weight carrying bar in a frame having several uprights;

No. 4,306,715 to J. W. Sutherland, 12-22-81, disclosed a four-upright frame with adjustable height horizontal bars or side-safety-rails;

No. 4,319,747 to J. F. Rogers, 3-16-82, disclosed a form of combined apparatus for use with barbells.

SUMMARY OF THE INVENTION

A principal object of the invention is to provide a new weight lifting system which combines features of a guided leg press apparatus and of a power rack type apparatus but which makes available new advantages in weight lifting over both types of apparatus taken separately. The massive weight support or weight holding features of the "free weight" power rack type apparatus have been innovatively incorporated into a guided leg press apparatus to provide a unique safety system for guided weight lifting apparatus.

Further objects are to provide a multi-use weight lifting system as described which provides versatile weight training capability for performing bench-presses, standing military presses, leg squats and numerous other weight lifting activities by using the weight support features of the power rack type apparatus for the guided, vertical multi-press system.

Still further objects are to provide a system as described which permits the safe use of more than one barbell at a time in the slider system, thereby increasing the weight-load capacity of the slider system.

Still further objects are to provide a system as described which uses a rotating foot-plate for the guided leg press function, thereby adding to foot-press safety and comfort.

Still further objects are to provide a system as described which permits simultaneous use of more than one side of the apparatus for various types of weight lifting activities, and which is economical, compact and durable.

BRIEF DESCRIPTION OF THE DRAWINGS

The above and other objects and advantages of the invention will become more readily apparent on examination of the following description, including the drawings in which like reference numerals refer to like parts.

FIG. 5 is a perspective view showing another mod of use, the foot-plate being removed for the purpose;

FIG. 6 is a perspective detail showing two barbell supported by the apertured flanges;

DETAILED DESCRIPTION

Figure 1:
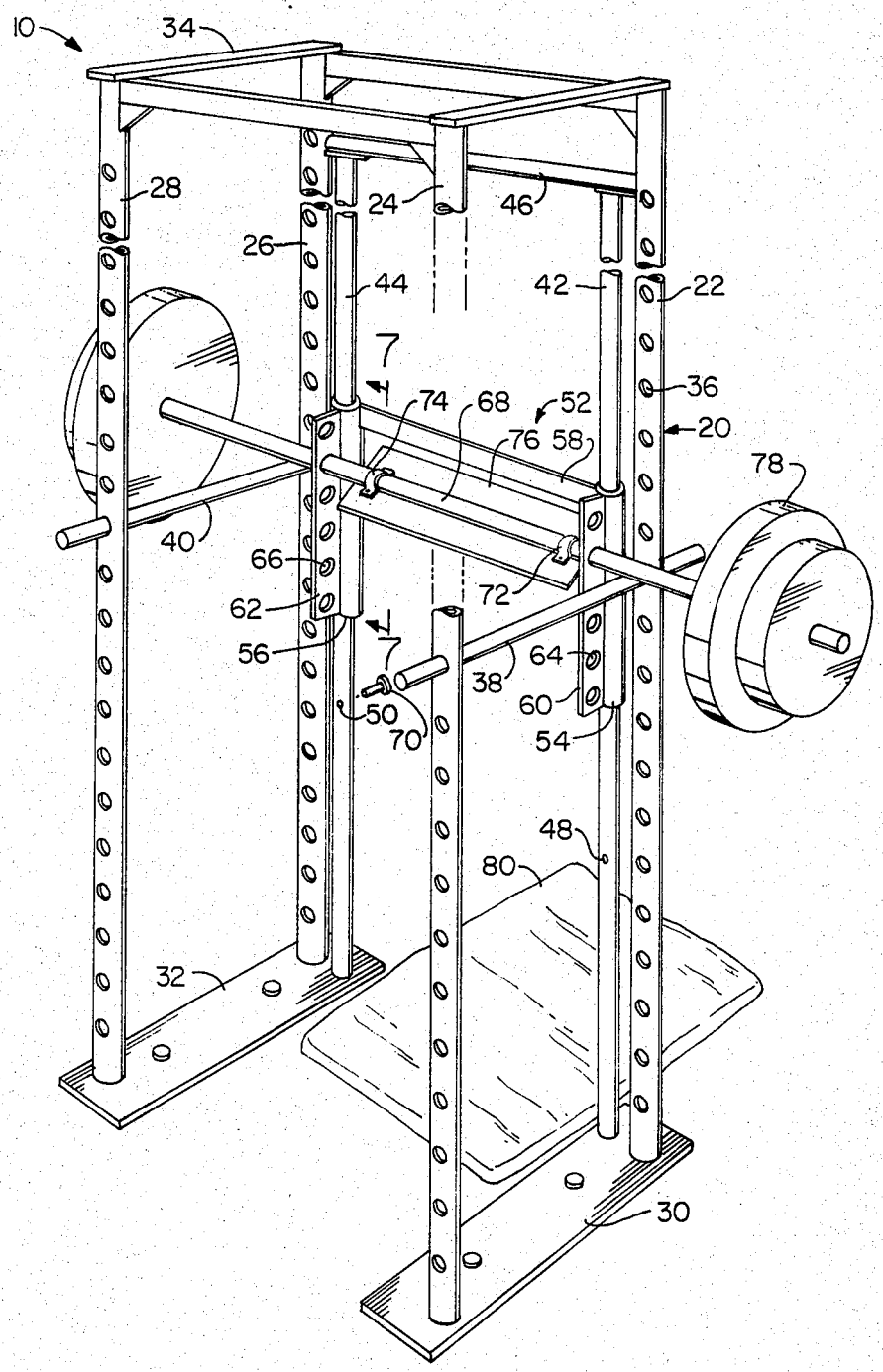
FIG. 1 is a perspective view of the invention, partially broken away for exposition.
Figure 2:
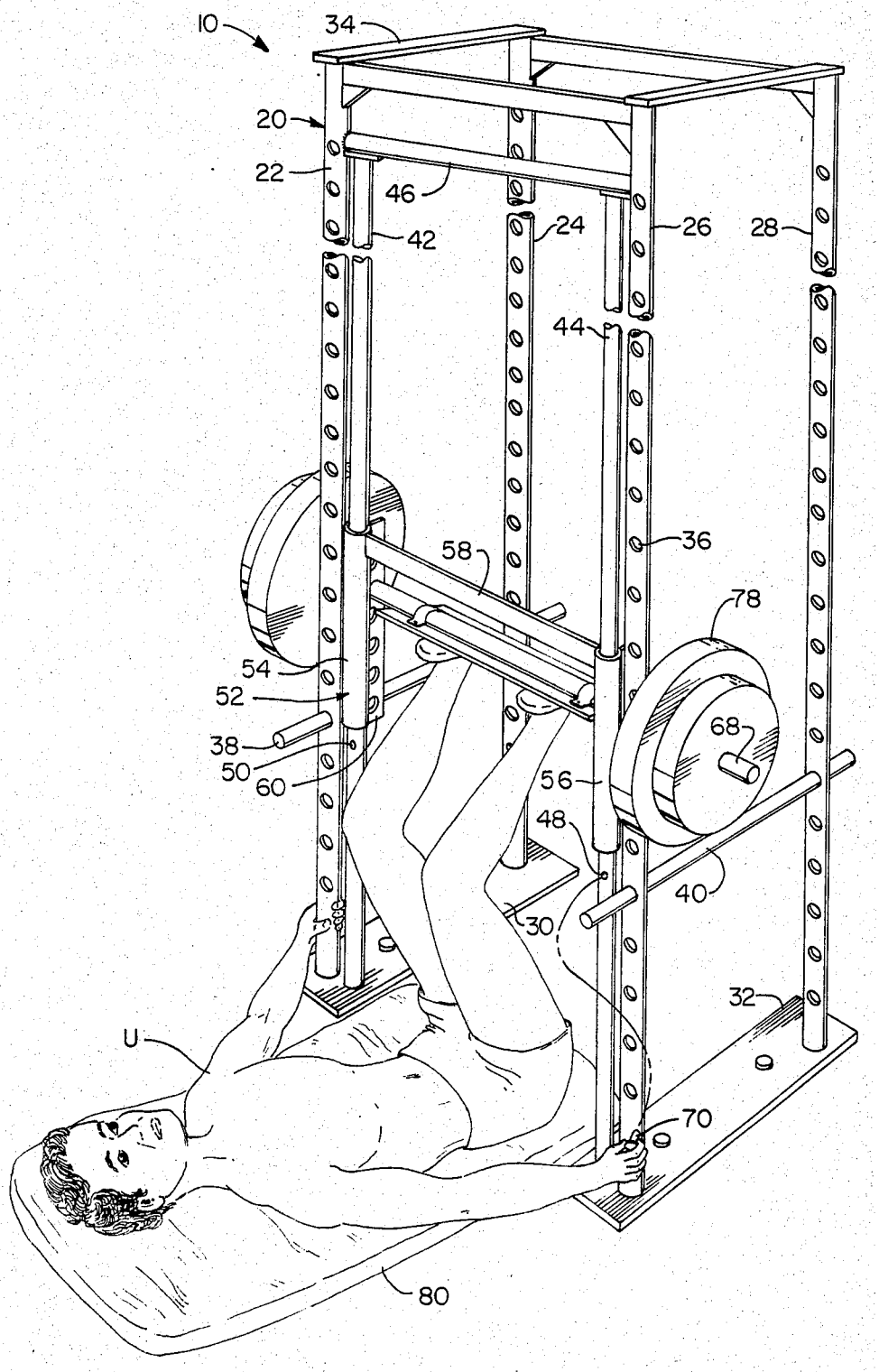
FIG. 2 is a perspective view of the invention in a mode of use.

FIGS. 1 and 2 show the invention in embodiment 10 Frame 20 may be of pipe and in other ways similar to typical power rack apparatus. Four parallel uprights 22 24, 26, 28 are conventionally spaced in rectangular pla configuration by plates 30, 32 joining them in pairs a the bottom and by four transverse connections 34 at th top.

Each upright has a uniform, vertical series of holes 3 transversely through the walls, the holes in the first pai of side uprights 22, 24 being in coaxial alignment an the holes in the second pair of side uprights 26, 28 corre sponding and similarly being in coaxial alignment.

A respective support rod 38, 40 is provided for de tachable mounting on each side and it is a solid steel ro sized to slip horizontally through the holes 36, joinin the uprights in pairs at any chosen level provided for b the hole spacing, which may be three inches (7.5 cm) o centers. Support rod diameter may be ¾ inch (10 mm) t one inch (2.5 cm).

Co-acting in the provision that the support rods ca be used at any chosen level is a combined guided le press or guided bench-press or guided standing-pres provision.

For this co-acting provision, first and second vertica guide shafts 42, 44, which may be either steel pipe o solid steel shafting, are respectively fixed in proximat parallel-spaced relation on the inner side of each of th rear uprights 22 and 26, that is, between the uprights 2 and 26 by the weld-attached plates 30, 32 at the botton and by a weld-attached cross tube 46 at the top extend ing between uprights 22 and 26, and fixing the uppe ends of the guide shafts 42, 44.

Each of the guide shafts 42, 44 may have a respectiv hole 48, 50 through it in a fore-and-aft direction abou one foot (30 cm) to eighteen inches (45 cm) from th bottom. The guide shafts 42, 44 are at the rearwar aspect of the invention 10.

A slider system 52 which is held by and disposed fo sliding up and down the guide shafts, includes a respec tive slider sleeve 54, 56 on each guide shaft, a cros member 58 welded to and joining the tops of the slide sleeves and a respective transversely apertured flang 60, 62 extending forwardly along the length of eac slider sleeve; the apertured flanges are parallel to each other and to the slider sleeves.

As means for adjustably securing a barbell which is an assembly of weight plates on a weight lifting bar, each of the apertured flanges 60, 62 may have an identical, uniformly spaced series of apertures or holes 64, 66 vertically along it, in a direction through it that is transverse to the flange and to the direction of the holes 36 in the uprights. Vertical spacing for the series of apertures or holes 64 and 66 may be the same as for holes 36. All apertures or holes in the apertured flanges 60, 62 should be of a size to receive through them in a free-sliding relation the weight lifting bar, 68 shown, of a standard barbell, perhaps one inch (2.5 cm) to 1⅛ inches (2.8 cm) in diameter.

The width of the invention 10 between uprights 22 and 26 may be about 40 inches (one meter) for example. The distance between uprights 22 and 24 may be in the range of 3 inches (75 mm) to 30 inches (0.75 m) for example. Height may be such as to permit a nominal size man to do a standing military press inside the frame 20, using the slider system.

OPERATION AS A GUIDED LEG PRESS

The user "U" selects a starting height at which he or she would feel most comfortable to begin a leg press of the barbell, by the following procedure. For this, he (or she) places a removable rest pin 70 in each of the holes 48, 50 in the respective lower portions of the guide shafts 42, 44.

Next, he lowers the slider system 52 until the lower ends of the slider sleeves 54, 56 rest on the rest pins 70. Then, having chosen his starting height, he runs a weight lifting bar 68 through the appropriate-height aperture or hole in one flange 60, through the free-swivels 72, 74 of the foot-plate 76, and through the co-aligned apertures or holes in the other flange 62. At this point, the weight plates 78 can be put on the ends of the weight lifting bar 68.

Next, the user decides at what height he would like to have the weight lifting bar 68 arrested should he slip or fail to maintain control of the barbell while leg pressing. To underpin this height, he inserts a support rod 38, 40 through the selected holes 36 in the first pair 22, 24 of uprights and similarly through the holes in the second pair 26, 28 uprights.

The user is now ready to lie on pad 80 and leg press the barbell and slider system upward, knowing that he is lying beneath a safety system that is virtually failsafe when properly used with the recommended barbell weight-load capacities. Once the support rods 38, 40 are in place, the safety system is operational. Consequently, no further safety measures, such as having to replace a safety pin or turn a safety catch, need be taken by the user during the leg press, thereby eliminating danger from human error and eliminating or reducing fear of being caught under the barbell.

As FIG. 2 shows, this new safety system for guided weight lifting apparatus is comprised of three distinct structural parts. The parts of the safety system are the two pairs 22, 24 and 26, 28 of uprights, the support rods 38, 40 and the holes 36 in the uprights which provide for height adjustment of the support rods.

With the support rods inserted into the recommended holes (the holes that are at a level optimally suited for the user's body size and leg length) in the upright pairs 22, 24 and 26, 28, the integrity of the safety system is established prior to the start of the leg press movement, thereby making the safety system very nearly failsafe. To verify that the safety system is virtually failsafe, one has only to evaluate the consequences of some of the worst-case problems that could be imagined to develop while using the guided leg press.

Obviously, muscular fatigue and muscular injury would be two serious problems that the user might experience while positioned under the barbell assembly 68, 78. The safety system easily handles these problems because the user needs only to lower the barbell down onto the support rods 38, 40 which the user had already positioned in the holes 36 of the upright pairs in preparation for leg pressing the barbell. Even if the user were to lose consciousness while lying beneath the barbell, he would, in most instances, be shielded from serious trauma to the head, neck, spine, chest and abdomen because the barbell would once again drop onto the support rods 38, 40 which are properly positioned above the unconscious user (this assumes that the user had positioned the support rods at a level that would be high enough to keep the descending barbell from crushing his legs down into his chest and abdomen).

One of the worst structural problems that could be imagined, as a final example, is the breaking loose or breaking apart of the guided leg press (the slider system 52 and/or guide shafts 42, 44). This would create a situation where the barbell assembly 68, 78 no longer has structural support in the horizontal plane. However, even with the barbell free to move in both the horizontal and vertical planes, the user is still afforded superior bodily protection because the weight lifting bar 68 is housed within a "safety channel" formed by the pairs 22, 24 and 26, 28 of uprights, and the support rods 38, 40. Consequently, the falling barbell should be held within the "safety channel" in the fore-and-aft directions by the vertical uprights, thereby allowing the barbell to drop down onto the horizontal support rods. As can be seen, the safety system handles even the most serious problems with almost failsafe reliability.

Note also that the invention was designed with one additional safety feature, that being the placement of the weight plates 78 on the outside of the uprights 22, 24, 26 and 28. Because of this added feature, even if the weight plates should slide off of the ends of the weight lifting bar 68, or even if the weight lifting bar should be sheared in half upon impact at both support rods 38 and 40, the weight plates should in both cases drop to the floor on the outside of the four uprights.

Figure 3:
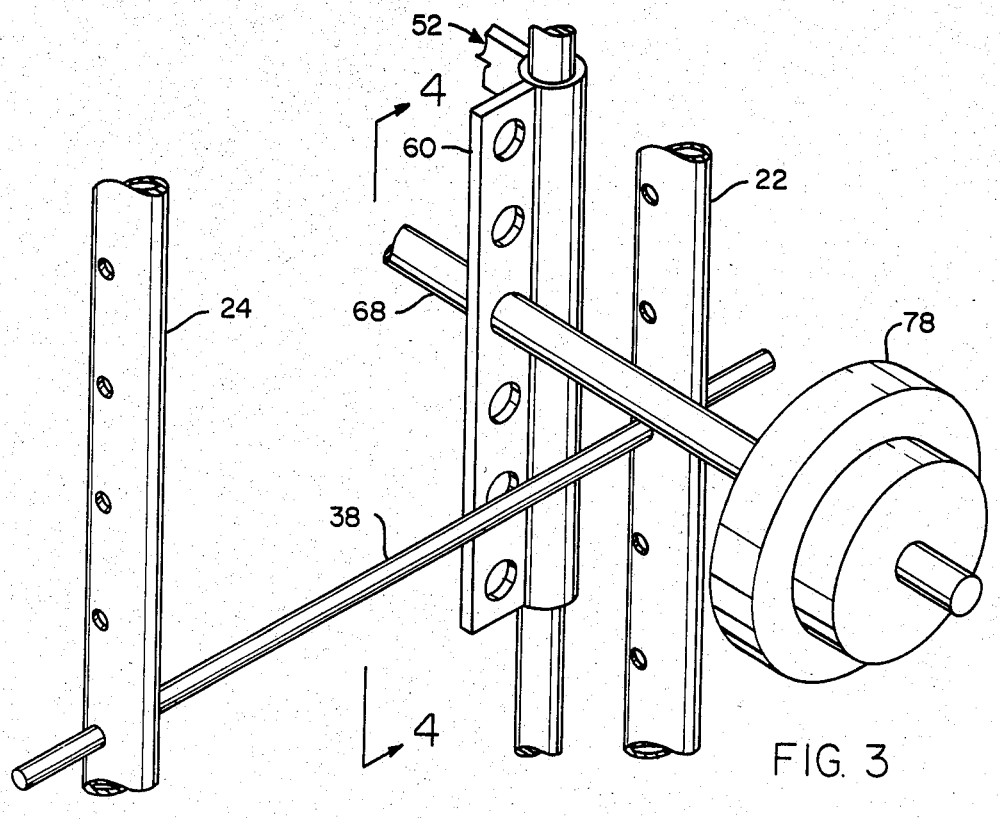
FIG. 3 is an enlarged, fragmentary perspective detai adapted from the FIG. 1 view.

FIG. 3 is a fragmentary detail, enlarged, taken from FIG. 1 which focuses on the interaction between slider system 52 with weight lifting bar 68 and the safety system that was described above. This drawing clearly shows that the horizontal weight lifting bar 68 extends perpendicularly through the two imaginary vertical planes that are formed by the pairs 22, 24 (shown) and 26, 28 of uprights, and that the weight lifting bar is transverse to and above (in spatial relationship) the support rods 38 (shown), 40, which are horizontally positioned within the aforementioned imaginary vertical planes. As can be recognized, the weight lifting bar is housed within a "safety channel" that is formed by the front uprights 24 (shown), 28, the rear uprights 22 (shown), 26, and the support rods 38 (shown), 40. Consequently, forward and rearward displacement of the barbell assembly 68, 78 should be blocked by the respective front and rear pairs of uprights, while downward movement of the barbell is arrested by the support rods, assuming that the recommended weight-load capacity of the safety system is not exceeded.

Figure 4:
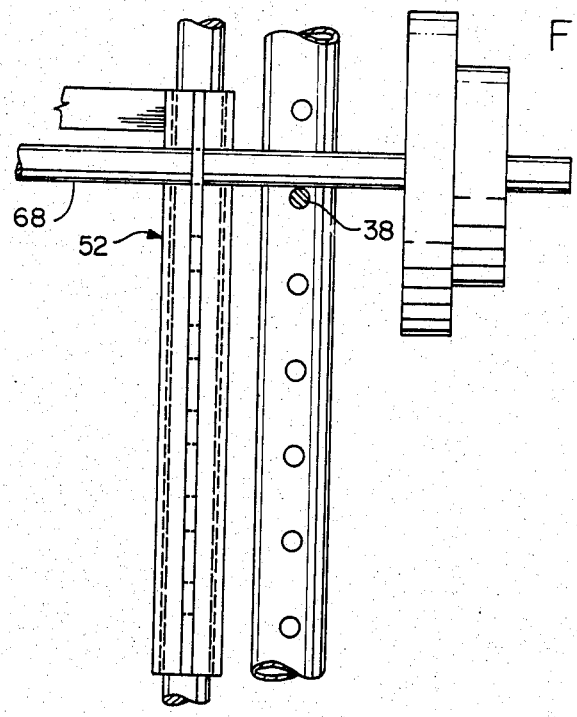
FIG. 4 is a fragmentary elevational detail taken a 4—4, FIG. 3.

FIG. 4 is a detail taken at 4—4, FIG. 3 to emphasize the safety feature of massive support and back-stopping by the support rods, 38 shown, positioned under the weight lifting bar 68 of the barbell in assembly 52.

OPERATION AS A GUIDED MULTI-PRESS

Further, support rods 38, 40 can act as rest stops when the user's hands are incorporated in the exercises, as in bench-pressing. There is good access all around for the insertion and use of a bench.

FIG. 5 shows, for example, the use of the invention 10 in performing a standing-press, with the foot-plate removed. The beginning user can set-up the system with the support rods 38, 40 at a desired starting height (example: shoulder level) and with the barbell, which is secured in the slider system 52, resting on the support rods. The user can then push the barbell overhead without fear of toppling forward or backward, or of getting crushed by the weight of the barbell assembly 68, 78, since the barbell can only descend as low as the support rods 38, 40.

A further feature evident is that the cross tube 46, connecting the first and second guide shafts 42, 44 at the top to uprights 22 and 26, can be used for chin-up exercises. It will be apparent that the uprights are also available for all ordinary uses as a power rack apparatus, as for free-weight exercises using bar-holders 90.

OTHER FEATURES OF THE INVENTION

FIG. 6 shows another feature which the invention makes possible. More than one barbell at a time can be employed by securing weight lifting bars 68, 68′ in separate levels of the apertures or holes (66 shown) in the apertured flanges (62 shown).

Because the apertured flanges will accommodate a two weight lifting bar set-up, the weight-load capacity (total) for the invention is increased. Not only is total weight-load capacity increased, but single barbell weight-loads (in the 850 to 1,000 lbs. range) that might bind-up the slider system 52 on the guide shafts (44 shown) because of excessive deflection of a single weight lifting bar within the flange/slider sleeve unit (62, 56 shown) can now be handled because these heavy poundages can be distributed with the two weight lifting bar set-up so that excessive deflection of either weight lifting bar is avoided.

Figure 7:
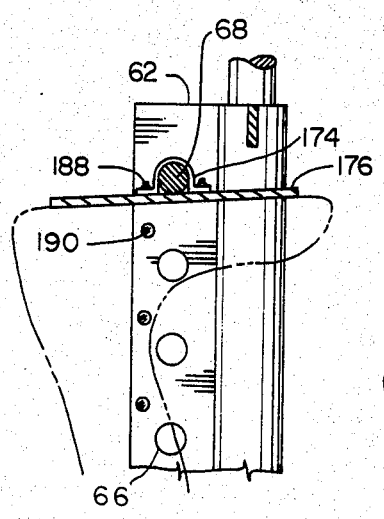
FIGS. 7, 8 and 9 are successive-position elevationa details, partly in section, of a modified foot-plate ar rangement, the view being otherwise adapted fron 7—7, FIG. 1.
Figure 8:
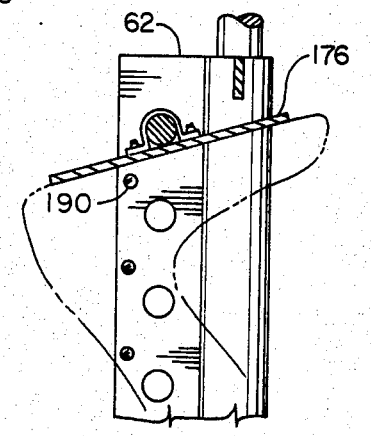
Figure 9:
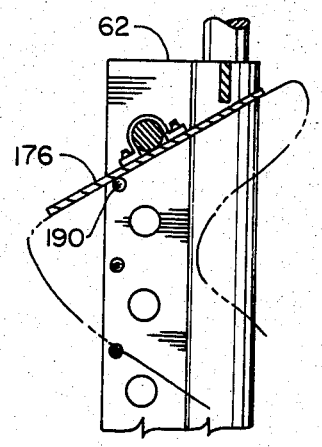

FIGS. 7, 8 and 9 show successive positions in a view adapted from FIG. 1 at 7—7 of an alternative foot-plate detail. According to this invention, the foot-plate 176 swivels on the weight lifting bar 68, providing added foot-press safety and comfort during the leg press movement. The significance of the swivel motion of the foot-plate can be understood by first reviewing the movement patterns that the foot and ankle undergo with a stationary type foot-plate.

When the foot-plate is fixed in a horizontal position, as is usually the case with current-style leg press machines, the heel of the foot will usually lift off of the foot-plate as the barbell is lowered toward the floor. As the heel comes off of the foot-plate, barbell weight (i.e., force) is placed predominantly on the distal heads of the metatarsal bones, concentrating these forces on a very limited portion of the plantar surface of the foot. Because the weight is no longer optimally distributed over the entire plantar surface of the foot, there is greater probability of injury occuring to the metatarsal bones, to the ligaments of the foot arch, and to the ankle join since this joint is usually forced into extreme dorsiflex ion when a fixed, horizontal foot-plate is used.

On the other hand, a rotating or swivelling foot-plate (as introduced in this invention) allows the entire plan tar surface of the foot to maintain contact with the foot-plate during the leg press. Consequently, the forces are more evenly distributed on the metatarsal bones thereby reducing the chances for foot injury. Additionally, because the ankle joint can maintain a more neutral position throughout the leg press movement (as opposed to being forced into extreme dorsiflexion with the fixed-style foot-plate), there is reduced risk of injury to the ankle joint also.

As shown in FIGS. 7, 8 and 9, detachable screws and nuts 188 and "C" shaped clamps 174 loosely and adjustably fasten foot-plate 176 to the weight lifting bar 68 so that the swivelling action can take place. Each aperture or hole 66 in the flange 62 may have below it at an angle a lug 190 protruding in position for limiting rotation of the foot-plate for safety to about 45 degrees from the horizontal.

ALTERNATIVE SUPPORT ROD CONSTRUCTION

Figure 10:
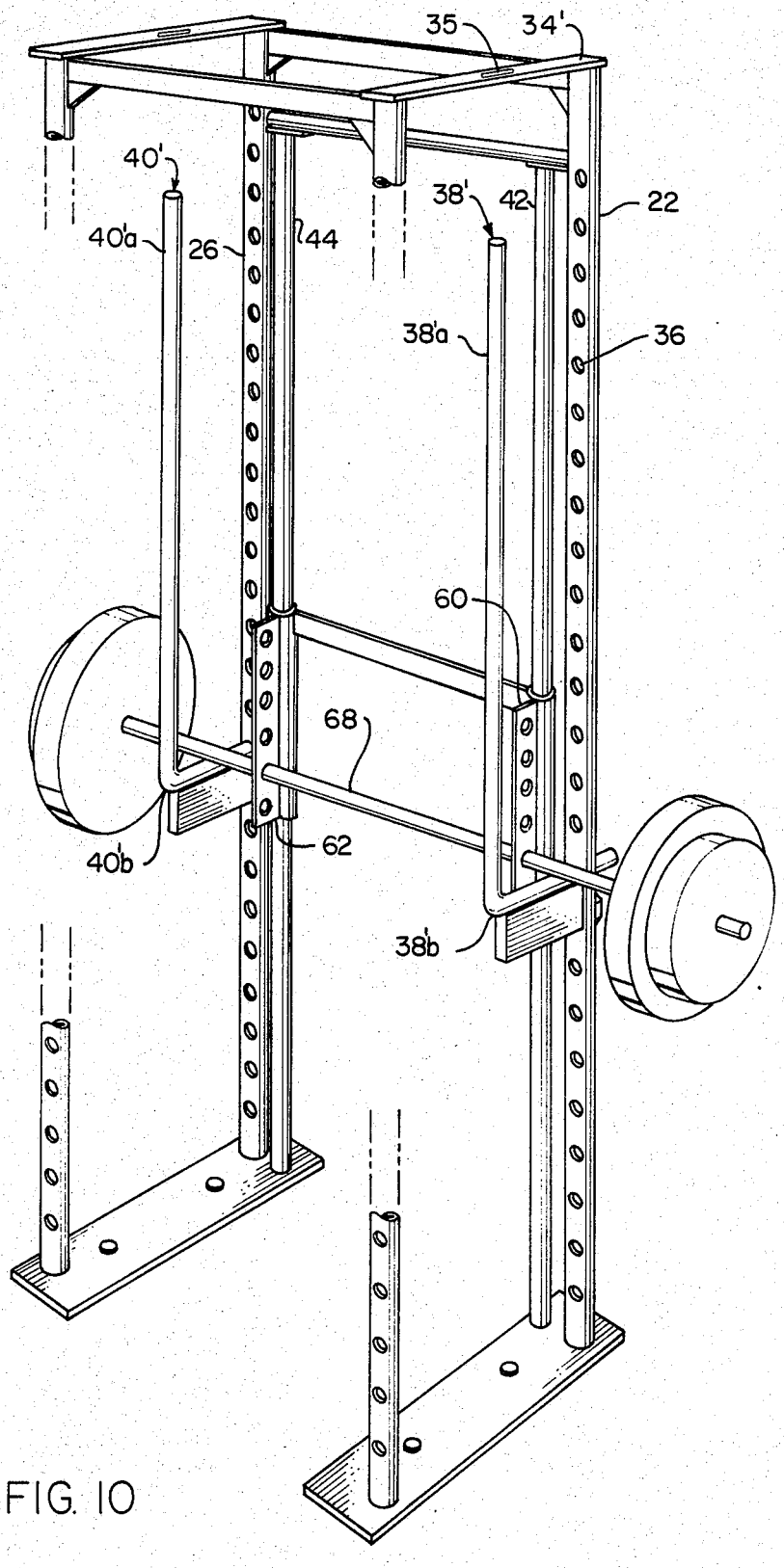
FIGS. 10 and 11 are perspective views of a secon embodiment of the invention using alternative suppor rod assemblies.
Figure 11:
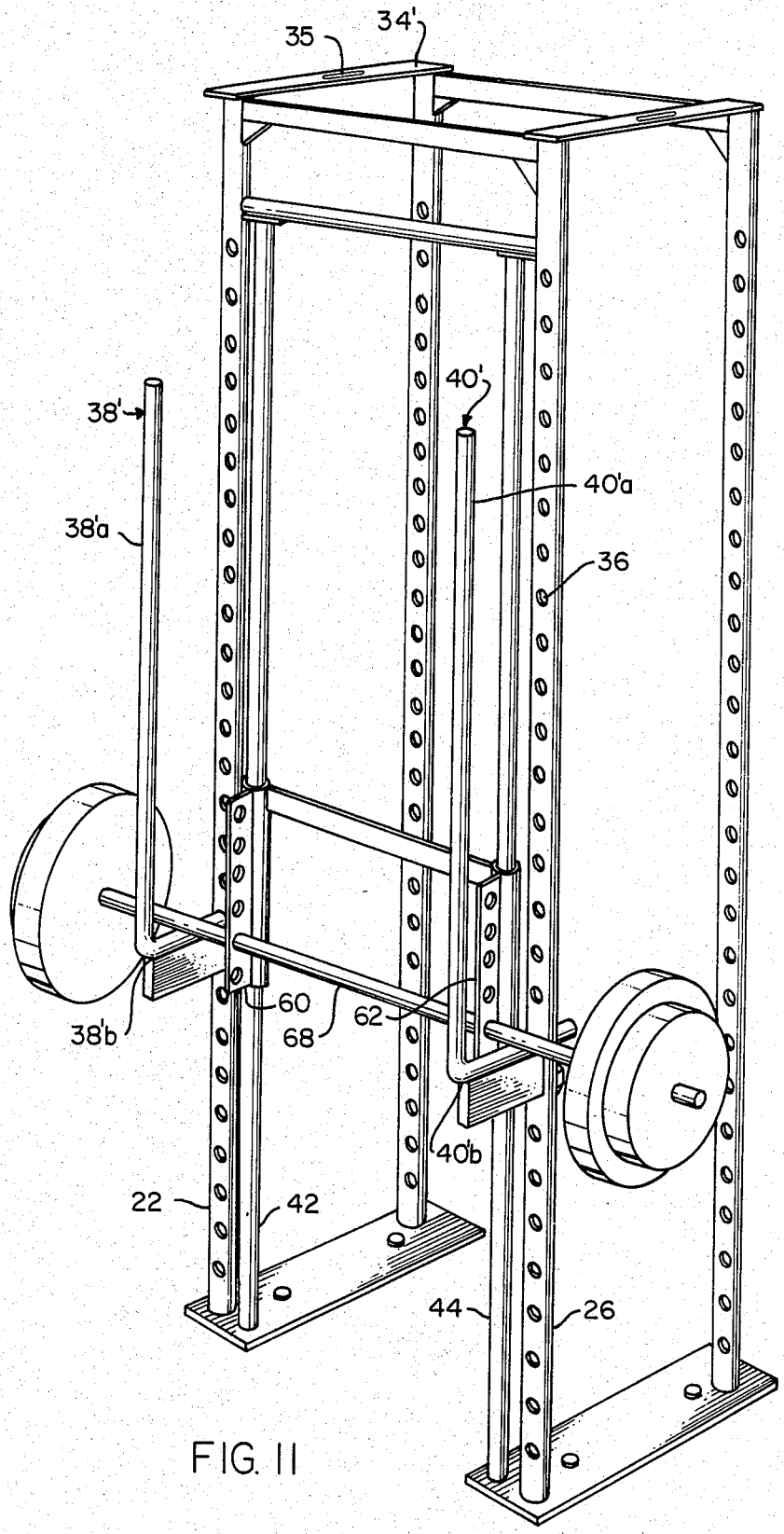

FIGS. 10 and 11 show the invention using support rod assemblies 38′ and 40′, which represent a modification of the basic support rods 38, 40 used in FIG. 1. Support rods 38′ and 40′ are designed to use with only the two uprights 22, 26 which are respectively fixed in proximate parallel spaced relation on the outside of each of the vertical guide shafts 42, 44 of the guided leg press.

These support rod assemblies 38′, 40′ provide the user of the invention with the same kind of safety system, namely the adjustable "safety channel", as described earlier. When the support rod assemblies 38′, 40′are used instead of the standard support rods 38, 40 (FIG. 1), the "safety channel" is formed by the two vertical uprights 22, 26, the upright members 38′*a*, 40′*a* of the support rod assemblies, and the support rods 38′*b*, 40′*b* of the support rod assemblies.

Notice also that the use of the support rod assemblies 38′, 40′ allows the user of the invention to position the apertured flanges 60, 62 of the slider system in either the forward (FIG. 10) or rearward (FIG. 11) facing direction for the invention. Slots 35 in transverse connections 34′ will accept the upright members of the support rod assemblies, 38′*a* for example, so that the support rod assemblies, 38′ for example, can be raised to any height necessary in performing overhead weight lifting exercises.

Figure 12:
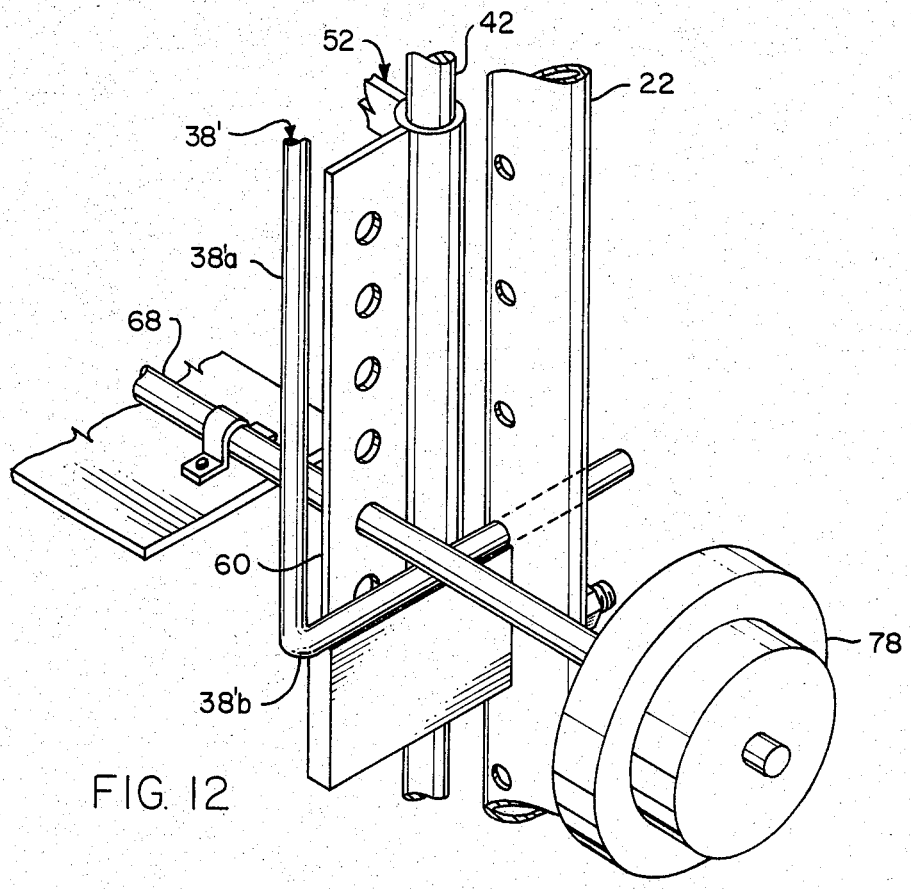
FIG. 12 is an enlarged perspective detail of the sup port rod assembly from FIG. 11.

FIG. 12 is a fragmentary detail, enlarged, adapted from FIG. 11 which shows that the weight lifting bar 68 is captured within the "safety channel" that is formed by the uprights (22 shown), the upright members (38′*a* shown) of the support rod assemblies, and the support rods (38′*b* shown) of the support rod assemblies.

Figure 13:
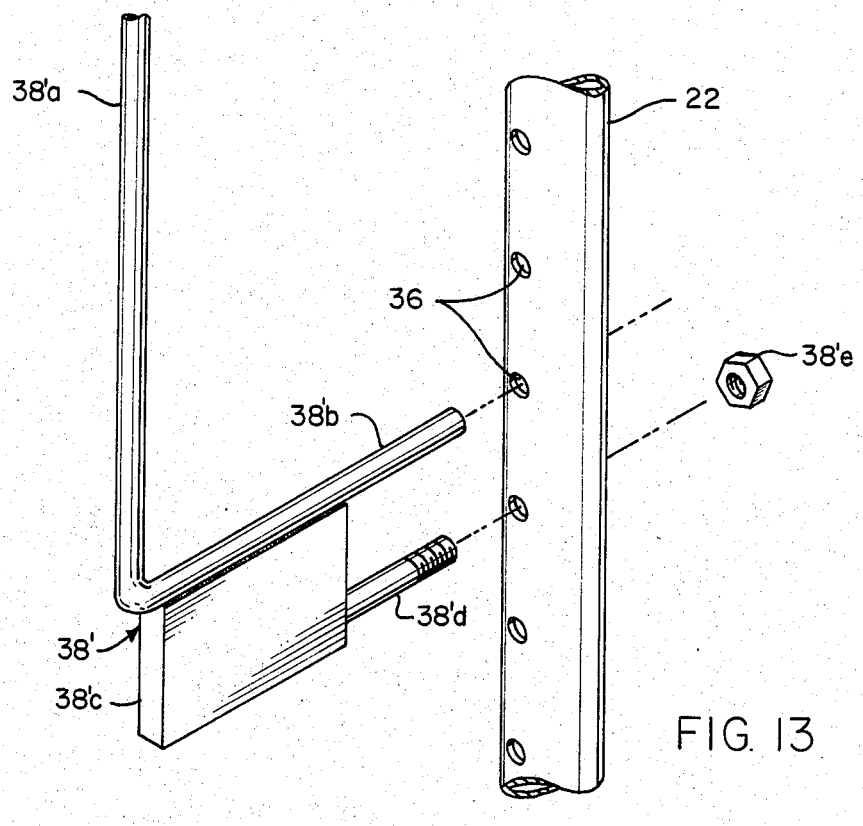
FIG. 13 is an exploded detail generally as viewed i FIG. 12.

FIG. 13 details a support rod assembly (38′shown) that has been detached from the upright (22 shown). The support rod assembly is made up of the following portions. The first portion is a support rod (38′*b* shown), perhaps a steel rod that is 10 inches long and ¾ inch to one inch in diameter. The second portion is an upright member (38′*a* shown), perhaps a steel rod that is 40 inches in length and ¾ inch to one inch in diameter. The upright member is welded at one end to one of the ends of the support rod (38′*b* shown), and the length of the upright member of the support rod assembly should be such as to accommodate the use of two weight lifting bars within each apertured flange as shown at 62, FIG. 6. The third portion is a steel brace plate (38'*c* shown), perhaps four inches square by ½ inch in thickness, that is welded along one of its narrow edges to the support rod (38'*b* shown) on the side opposite the upright member (38'*a* shown). After the brace plate is welded to the support rod, the free end of the support rod (38'*b* shown) must be proportioned for passing through a hole 36 of the upright. The next portion is a threaded member (38'*d* shown), perhaps a threaded steel rod that is 6 inches in length and ¾ inch in diameter, which is welded at one end to the narrow edge of the brace plate that is parallel to but farthest from the upright member (38'*a* shown). The threaded member is affixed in parallel spaced relation to the support rod (38'*b* shown) in all planes, and the distance between the support rod and the threaded member, center to center, is the same as the distance, center to center, between any two successive holes 36 in an upright (22 shown). Also, the threaded member should be proportioned for passing through a hole 36 of the upright. The final portion of the support rod assembly is a nut (38'*e* shown) which detachably fastens the threaded member to the upright (22 shown).

As can be seen, the free ends of both the support rod (38'*b* shown) and the threaded member (38'*d* shown) can be inserted simultaneously through any two successive holes 36 in the upright (22 shown). The nut (38'*e* shown) can then be threaded onto the threaded member (38'*d* shown), thereby mounting the support rod (38'*b* shown) to the upright.

ALTERNATIVE APERTURED FLANGE CONSTRUCTION

Figure 14:
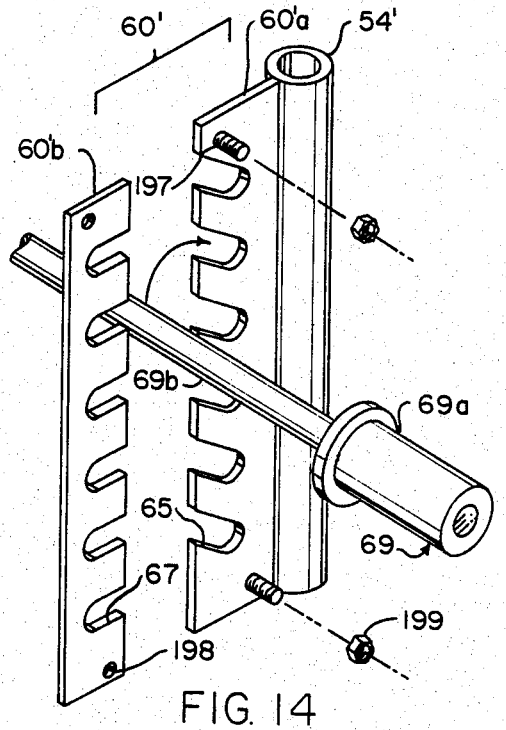
FIGS. 14 and 15 are fragmentary perspective detail showing successive positions of a modified embodimen of the apertured flange structure.
Figure 15:
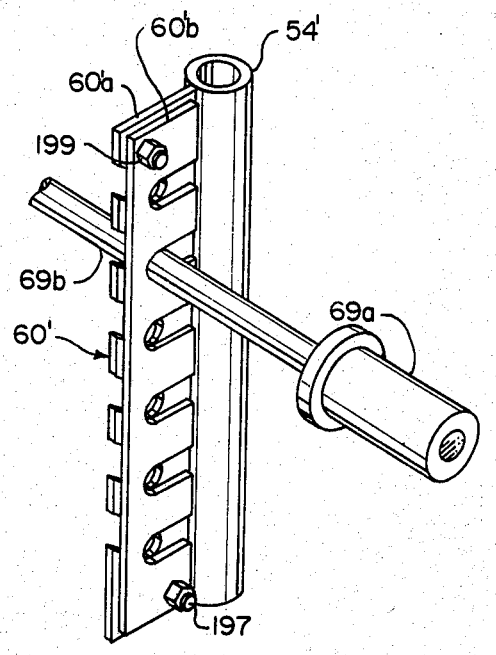

FIGS. 14 and 15 show successive positions of assembly for an apertured flange 60' which will permit the use of Olympic weight lifting bars in the invention. Because the Olympic weight lifting bar 69 has end portions 69*a* that are over two inches in diameter, this weight lifting bar will not slide through the one inch to 1½ inch holes (see FIG. 1, 64) that might be drilled in the apertured flange.

FIG. 14 shows the two-piece apertured flange 60' disassembled, with the Olympic weight lifting bar outside the flange. As can be seen, flange piece 60'*a* is welded along the length of the slider sleeve 54'. However, instead of having holes drilled through this flange piece to secure a weight lifting bar, flange piece 60'*a* has a vertical series of identical, uniformly spaced apertures or notches 65, extending diagonally downward in it from one edge. These nothches 65 may be 2⅛ inches in length, one inch to 1½ inches in width, and angled downward at 10 degrees from the horizontal. These notches are transverse to the flange piece and they accept the hand-held portion 69*b* of the Olympic weight lifting bar. Additionally, two screw studs 197 project perpendicularly from flange piece 60'*a*.

The second piece of the apertured flange 60' is a screw and nut attached, flat steel keeper-plate 60'*b* with a vertical series of identical, uniformly spaced horizontal notches 67, perhaps 1⅛ inches in length, and one inch to 1½ inches in width. These notches 67 are transverse to keeper-plate 60'*b*, and vertically spaced to match with the notch spacing in flange piece 60'*a* at the lowest portions of the notches 65. Also, keeper-plate 60'*b* has two holes 198 that match-up with, and that accept the screw studs 197 which project from flangel piece 60'*a*.

FIG. 15 shows keeper-plate 60'*b* attached to flange piece 60'*a* by the nuts 199 which have been threaded onto the screw studs 197. With apertured flange 60' assembled, the hand-held portion 69*b* of the Olympic weight lifting bar is secured in place within the apertured flange by the opposing notches of flange piece 60'*a* and keeper-plate 60'*b*. Apertured flange 60' will accept the hand-held portion of most weight lifting bars currently in use.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system employing a frame of the power rack type which may be used with a barbell that includes an assembly of weight plates on a weight lifting bar and which is of the type having: a plurality of uprights held in generally rectangular plan-relation as first and second pairs of uprights and each upright having vertically a generally uniform series of holes transversely therethrough, respective holes of the first pair of uprights being in horizontal alignment and respective holes of the second pair of uprights being in horizontal alignment, a first support rod mounted in a respective hole in at least one upright of said first pair of uprights, and a second support rod mounted in a hole in at least one upright of said second pair of uprights, the improvement comprising: means adapting said system for use as a safety system in performace by a user of guided leg presses, guided bench-presses, guided standing-presses and the like, said means adapting including: a slider system, means for holding said slider system between an upright of the first pair of uprights and an upright of the second pair of uprights, said slider system having means for adjustably securing said barbell in a horizontal position transverse to said first support rod and said second support rod with said barbell extending over and across said first support rod and said second support rod, said means holding the slider system permitting sliding of the slider system a distance upwardly from said first and second support rods, said means for holding the slider system including: first and second guide shafts, means for fixing said first and second guide shafts in parallel-spaced relation between an upright of said first pair of uprights and an upright of said second pair of uprights, said frame having a forward portion and a rearward portion, said first and second guide shafts being adjacent to said rearward portion, the slider system further including a respective slider sleeve on said first and second guide shafts, a cross member joining the slider sleeves, and said means for adjustably securing comprising a respective flange extending in a fore-and-aft plane along the length of each slider sleeve.

2. In a system as recited in claim 1, each said flange of said means for adjustably securing having plurality of apertures therein in vertical series, and said flanges being parallel to each other.

3. In a system as recited in claim 2, said vertical series of apertures extending a distance vertically permitting securing two barbells therein at the same time.

4. In a system as recited in claim 2, said apertures comprising generally circular openings in said flanges.

5. In a system as recited in claim 2, said apertures comprising notches in said flanges.

6. In a system as recited in claim 5, a keeper-plate for each flange, and means for attaching each keeper-plate to each flange.

7. In a system as recited in claim 6, each said keeper-plate having a series of notches therein corresponding to said notches in each respective flange.

8. In a system as recited in claim 1, and means for connecting said first and second guide shafts at the upper ends thereof, comprising a horizontal member in position for use as a chin-up bar.

9. In a system as recited in claim 1, a foot-plate and means for rotably mounting the foot-plate to a weight lifting bar of said barbell secured in the slider system.

10. In a system as recited in claim 9, and means for limiting degree of rotation of said foot-plate.

11. In a system as recited in claim 10, said means for limiting degree of said rotation comprising a stop on at least one of said flanges.

12. In a system as recited in claim 1, first and second rest pins, and each of said guide shafts having a hole therein for receiving one of said rest pins below said slider system.

13. In a system as recited in claim 1, wherein the holes in the first and second pairs of uprights support the first and second support rods and enable said support rods to be detached from said pairs of uprights.

14. In a system as recited in claim 1, first and second support rod assemblies, said first and second support rods being respectively part of said first and second support rod assemblies.

15. In a system as recited in claim 14, each of said first and second support rod assemblies further including an upright member on each said support rod.

16. In a system employing a frame of the power rack type which may be used with a barbell that includes an assembly of weight plates on a weight lifting bar and which is of the type having: a plurality of uprights held in generally rectangular plan-relation as first and second pairs of uprights and each upright having vertically a generally uniform series of holes transversely there through, respective holes of the first pair of uprigh being in horizontal alignment and respective holes c the second pair of uprights being in horizontal aligr ment, a first support rod mounted in a respective hole i at least one upright of said first pair of uprights, and second support rod mounted in a hole in at least on upright of said second pair of uprights, the improve ment comprising: means adapting said system for use a a safety system in performance by a usaer of guided le presses, guided benchpresses, guided standing-presse and the like, said means adapting including: a slide system, means for holding said slider system between a upright of the first pair of uprights and an upright of th second pair of uprights, said slider system having mean for adjustably securing said barbell in a horizontal pos tion transverse to said first support rod and said secon support rod with said barbell extending over and acros said first support rod and said second support rod, sai means holding the slider system permitting sliding c the slider system a distance upwardly from said first an second support rods, first and second support rod as semblies, said first and second support rods being re spectively part of said first and second support ro assemblies, each of said first and second support ro assemblies further including an upright member on eac support rod, each of said first and second support rod having a free end proportioned for passing throug holes in said first and second pairs of uprights, threaded member proportioned for passing through one of hole in said uprights, a brace plate; said brac plate affixing the threaded member in parallel-spacin to the support rod, and means for detachably fastenin the threaded member to a hole in said upright.

17. In a system as recited in claim 16, each said up right member being located in spaced parallel relatio with a respective said upright, and each said uprigh member being adjacent to a respective one of said guid shafts upon said mounting of said support rod to a sai upright.

* * * * *

UNITED STATES PATENT AND TRADEMARK OFFICE

CERTIFICATE OF CORRECTION

PATENT NO. : 4,527,797

DATED : 7-9-85

INVENTOR(S) : JAMES R. SLADE, JR. and RICHARD F. STERBA

It is certified that error appears in the above-identified patent and that said Letters Patent are hereby corrected as shown below:

In the title page, under "OTHER PUBLICATIONS","Mary" should be -- Marcy --.

Col. 6, line 29 delete "rods" and insert -- rod assemblies --; delete "to" and insert -- for --.

Col. 8, line 61, after "having" insert -- a --.

Col. 10, line 10, delete "usaer" and insert -- user --.

Signed and Sealed this

*Twenty-eighth* Day of *January 1986*

[SEAL]

*Attest:*

DONALD J. QUIGG

*Attesting Officer*

*Commissioner of Patents and Trademarks*